US006098729A

United States Patent [19]

Matthias

[11] Patent Number: 6,098,729

[45] Date of Patent: Aug. 8, 2000

[54] PREFORM CUTTING ELEMENTS FOR ROTARY DRILL BITS

[75] Inventor: Terry R. Matthias, Upton St. Leonards, United Kingdom

[73] Assignee: Camco International (UK) Limited, Stonehouse, United Kingdom

[21] Appl. No.: 09/144,955

[22] Filed: Sep. 1, 1998

[30] Foreign Application Priority Data

Jun. 2, 1998 [GB] United Kingdom ..... 9811705

[51] Int. Cl.[7] ..... E21B 10/36

[52] U.S. Cl. ..... 175/420.1; 175/432; 175/435

[58] Field of Search ..... 125/425, 426, 125/428, 432, 435, 420.1

[56] References Cited

U.S. PATENT DOCUMENTS

| | | | |
|---|---|---|---|
| 5,435,403 | 7/1995 | Ortloff . | |
| 5,472,376 | 12/1995 | Olmstead et al. | 175/432 X |
| 5,492,188 | 2/1996 | Smith et al. | 175/432 |
| 5,605,198 | 2/1997 | Tibbitts . | |
| 5,967,249 | 10/1999 | Butcher | 175/432 X |
| 5,971,087 | 10/1999 | Chaves | 175/432 |

FOREIGN PATENT DOCUMENTS

| | | |
|---|---|---|
| 0 687 797 A1 | 12/1995 | European Pat. Off. . |
| 0 692 607 A2 A3 | 1/1996 | European Pat. Off. . |

*Primary Examiner*—Roger Schoeppel
*Attorney, Agent, or Firm*—Jeffery E. Daly

[57] ABSTRACT

A preform cutting element, for a rotary drag-type drill bit, includes a facing table of superhard material having a front face, a peripheral surface, and a rear surface bonded to the front surface of a substrate which is less hard than the superhard material. The facing table extends across only a part of the front surface of the substrate, and part of the substrate engages the peripheral surface of the facing table. When such a cutting element is mounted on a bit body with the part of the facing table periphery which is engaged by the substrate being located opposite the cutting edge of the element, the part of the substrate which engages the periphery of the facing table acts as a mechanical support to the facing table so as to resist impact and other loads to which the facing table may be subject in use.

27 Claims, 3 Drawing Sheets

FIG 1
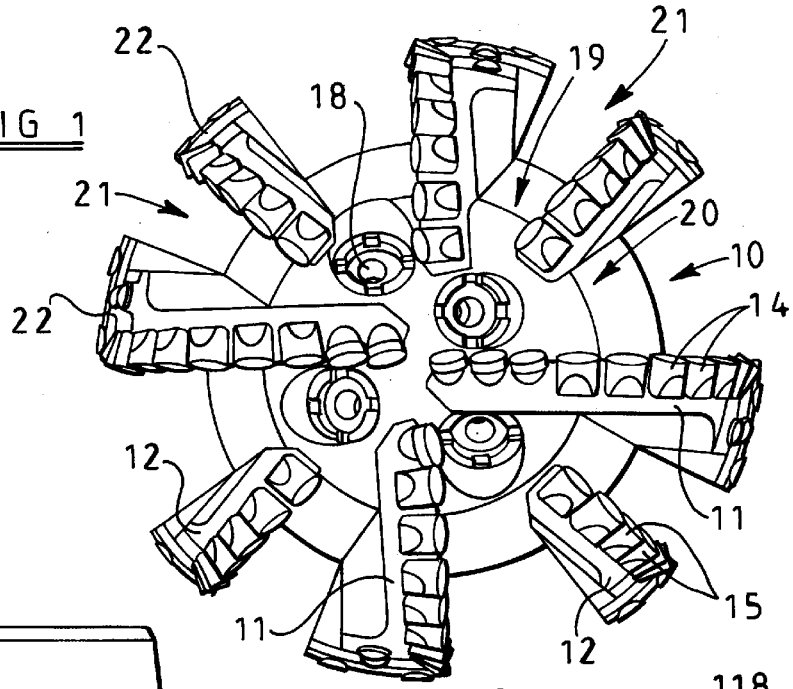
FIG 2
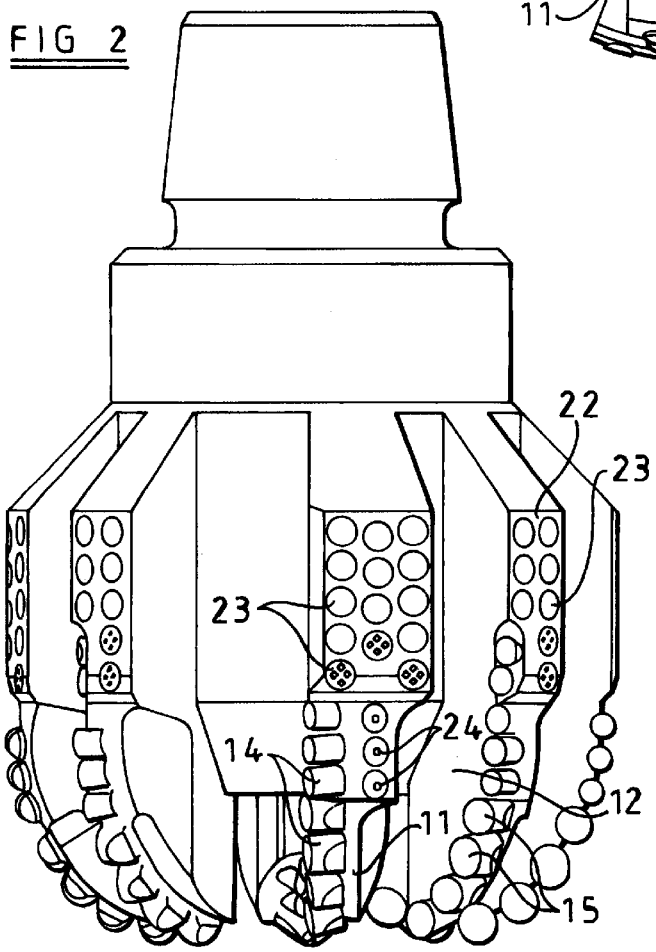
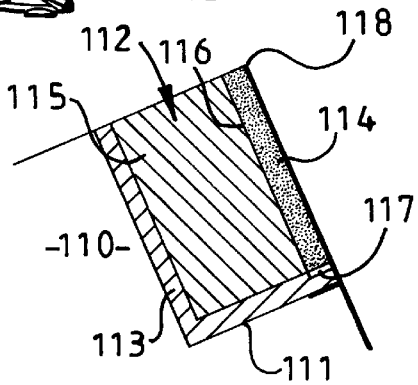
FIG 3
(Prior art)
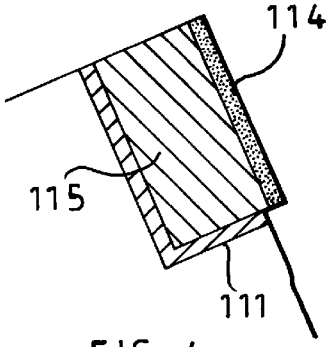
FIG 4
(Prior art)

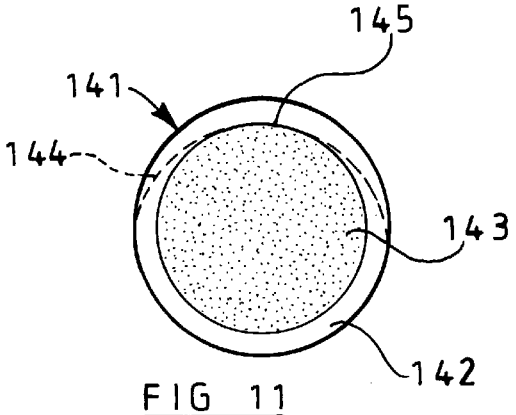
FIG 11
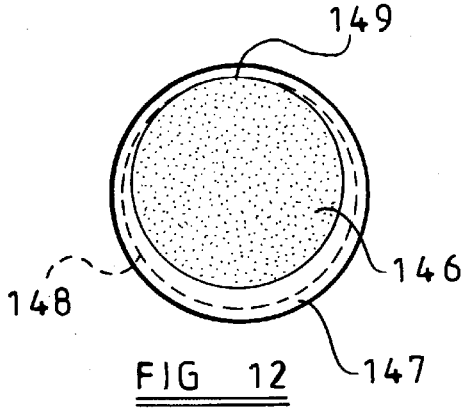
FIG 12
FIG 13
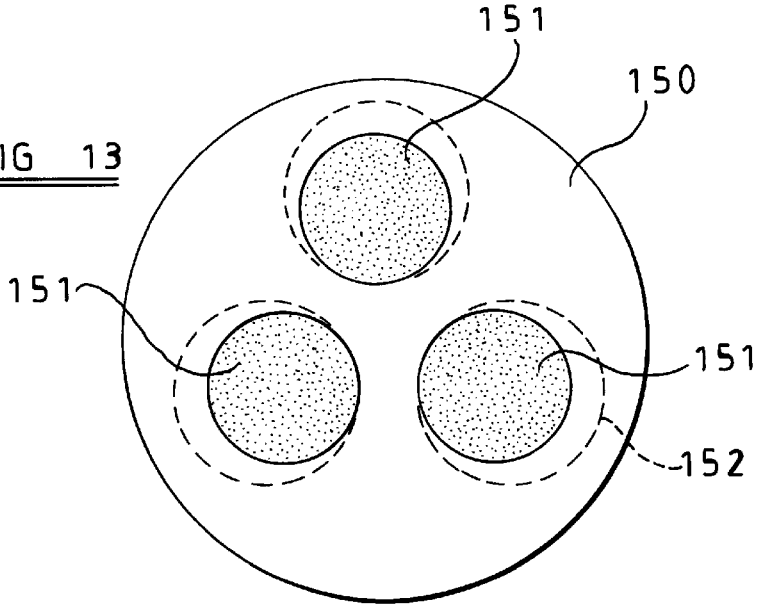

PREFORM CUTTING ELEMENTS FOR ROTARY DRILL BITS

BACKGROUND OF THE INVENTION

1. Field of the Invention

The invention relates to preform cutting elements for rotary drag-type drill bits, of the kind comprising a facing table of superhard material having a front face, a peripheral surface, and a rear surface bonded to the front surface of a substrate which is less hard than the superhard material.

2. Description of Related Art

Such preform cutting elements usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a pocket in the body of the drill bit. The carrier is often formed from cemented tungsten carbide, the surface of the substrate being brazed to a surface on the carrier, for example by a process known as "LS bonding". Alternatively, the substrate itself may be of sufficient thickness as to provide, in effect, a cylindrical stud which is sufficiently long to be directly received in a pocket in the bit body, without being first brazed to a carrier. The bit body itself may be machined from metal, usually steel, or may be molded using a powder metallurgy process.

In preform cutting elements of the above type the interface between the superhard table and the substrate may be flat and planar. However, the bond between the superhard facing table and the substrate may be improved by providing a configured non-planar interface between the rear face of the facing table and the front face of the substrate, so as to provide a degree of mechanical interlocking between the facing table and substrate.

In such preform cutting elements it is the usual practice for the facing table to extend over the whole area of the front face of the substrate so that the periphery of the facing table is exposed at the periphery of the preform element.

Such preform cutting elements are subjected to high temperatures and heavy loads when the drill bit on which they are mounted is in use down a borehole. It is found that as a result of such conditions spalling and delamination of the superhard facing table can occur, that is to say the separation and loss of the diamond or other superhard material over part or all of the cutting surface of the table.

It is believed that impact loads on the cutting edge of the facing table can initiate such spalling or delamination and such impacts can also cause cracking of the superhard facing table, which tends to be comparatively brittle.

Another disadvantage of existing designs is that when the cutting element is brazed into a pocket in the bit body, the braze alloy cannot wet or bond to the portion of the facing table which is exposed at the periphery of the cutting element. This not only reduces the effective braze area but also means that the bit body provides no effective support for the facing table at its periphery.

The present invention sets out to provide a novel and improved form of cutting element where these disadvantages may be reduced or overcome.

SUMMARY OF THE INVENTION

According to the invention there is provided a preform cutting element, for a rotary drag-type drill bit, including a facing table of superhard material having a front face, a peripheral surface, and a rear surface bonded to the front surface of a substrate which is less hard than the superhard material, the facing table extending across only a part of the front surface of the substrate, and part of the substrate engaging the peripheral surface of the facing table.

The peripheral surface of the facing table and/or the substrate may be circular, part-circular or of any other suitable shape.

When such a cutting element is mounted on a bit body with the part of the facing table periphery which is engaged by the substrate being located opposite the cutting edge of the element, the part of the substrate which engages the periphery of the facing table acts as a mechanical support to the facing table so as to resist impact and other loads to which the facing table may be subject in use, thereby reducing the shear stress which is otherwise wholly borne by the interface between the facing table and substrate.

Furthermnore, since the part of the substrate which engages the peripheral surface of the facing table may then lie between the facing table and the internal wall of a pocket in which the cutting element is mounted, the braze alloy can be bonded to the substrate material in this region, thereby increasing the area of bond when compared to a conventional cutting element of similar size.

Part of the peripheral surface of the facing table may be exposed at the periphery of the preform element, so as to define the cutting edge of the element.

Preferably the front face of the facing table is also exposed. Said part of the substrate which engages the peripheral surface of the facing table preferably has a front surface which is substantially co-planar with the front face of the facing table. The front face of the facing tables and the co-planar front surface of the part of a substrate, may be substantially flat.

The part of the substrate which engages the periphery of the facing table may also overlie part of the front face of the facing table. For example, the front face of the facing table may be formed with a rebate adjacent part of the periphery thereof, said rebate being at least partly filled with material of the substrate. The rebate may have a bottom wall and a side wall, or may comprise a chamfer extending from the periphery of the facing table to a region of the front face thereof inward of the periphery.

In one embodiment of the invention the facing table and substrate may have respective central axes, the axis of the facing table being displaced from the axis of the substrate so that one part of the periphery of the facing table lies at the periphery of the substrate and another part of the periphery of the facing table is spaced inwardly from the periphery of the substrate. The facing table and/or the substrate may be generally circular, although they might also be of any other suitable shapes.

In any of the above arrangements, an exposed part of the front face of the substrate may be formed with a rebate adjacent part of the periphery of the substrate. The rebate may have a bottom wall and a side wall, or may comprise a chamfer extending from the periphery of the substrate to a region of the substrate inward of the periphery. In the case where the preform element is mounted in a pocket in the bit body, a part of the material of the bit body may engage within said rebate so as to assist in retaining the element in the pocket.

In any of the above arrangements, there may be provided a non-planar interface between the rear surface of the facing table and the front surface of the substrate. For example, the facing table may be formed with a thickened peripheral wall or rim which projects into a correspondingly shaped groove in the front surface of the substrate. Alternatively or additionally, the rear surface of the facing table and the front surface of the substrate may be formed with any other configuration of inter-engaging projections and recesses.

Also in any of the above arrangements there may be provided a transition layer between the superhard material and the less hard material, the transition layer comprising material having one or more properties which is intermediate the corresponding properties of the superhard and less hard materials. In this case the transition layer may be regarded as forming part of the substrate or part of the facing table, depending on the configuration.

The invention includes within its scope a rotary drag-type drill bit having a bit body formed with at least one pocket in which is received a preform cutting element according to the invention, the pocket having an inner peripheral surface to which a part of the outer periphery of the preform element is brazed, including the outer periphery of said part of the substrate which engages the peripheral surface of the facing table.

The invention further provides a method of manufacturing a preform cutting element of any of the kinds referred to above, comprising forming an intermediate member having a facing table of superhard material extending across only a part of a substrate of less hard material, and then removing material from the intermediate member to leave a smaller preform element wherein only a part of the periphery of the facing table is exposed at the periphery of the preform element.

For example, the intermediate member may comprising a single facing table spaced inwardly from the periphery of the substrate, at least part of the periphery of the substrate of the intermediate member subsequently being removed, for example by grinding, to expose part of the periphery of the facing table. The facing table may be either concentrically of eccentrically located with respect to the substrate of the intermediate member.

Alternatively, the intermediate member may comprise a plurality of facing tables spaced apart on the front surface of the substrate of the intermediate member, each facing table, together with an adjacent larger area of substrate, being subsequently separated from the intermediate member to provide a plurality of preform elements in accordance with the invention.

BRIEF DESCRIPTION OF THE DRAWINGS

FIG. 1 is an end view of one form of rotary drill bit according to the invention.

FIG. 2 is a side elevation of the drill bit of FIG. 1.

FIG. 3 is a diagrammatic section through a prior art cutting element mounted on a drill bit, FIG. 4 is a similar view of an alternative prior art arrangement.

FIGS. 11–13 are plan views of intermediate members which may be used to manufacture cutting elements according to the present invention.

DETAILED DESCRIPTION OF THE PREFERRED EMBODIMENTS

Figure 5:
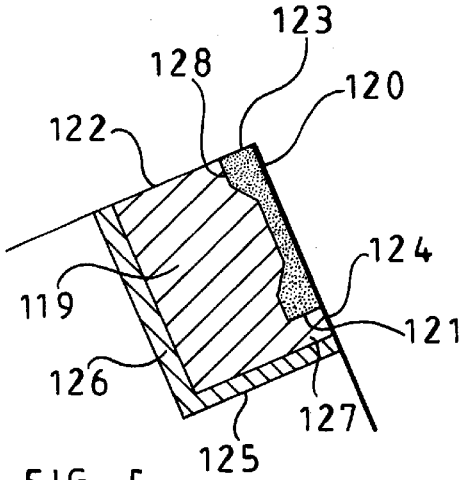
FIG. 5 is a similar view to FIG. 3 of a cutting element in accordance with the present invention.

Referring to FIGS. 1 and 2, the drill bit comprises a bit body 10 on which are formed four primary blades 11 and four secondary blades 12. The blades extend generally radially with respect to the bit axis.

The leading edges of the secondary blades are substantially equally spaced with respect to one another, but the leading edge of each secondary blade is closer to its associated preceding primary blade than it is to the following primary blade.

Primary cutters 14 are spaced apart side-by-side along each primary blade 11 and secondary cutters 15 are spaced apart side-by-side along each secondary blade 12. Each secondary cutter 15 is located at the same radial distance from the bit axis as an associated one of the primary cutters on the preceding primary blade.

Each cutter 14, 15 is generally cylindrical and of circular cross-section and comprises a front facing table of polycrystalline diamond bonded to a cylindrical substrate of cemented tungsten carbide. Each cutter is received within a part-cylindrical pocket in its respective blade.

The primary cutters 14 are arranged in a generally spiral configuration over the drill bit so as to form a cutting profile which sweeps across the whole of the bottom of the borehole being drilled.

The three outermost cutters 14 on each primary blade 11 are provided, in known manner, with back-up studs 24 mounted on the same primary blade rearwardly of the primary cutters. The back-up studs may be in the form of cylindrical studs of tungsten carbide embedded with particles of synthetic or natural diamond.

The bit body 10 is formed with a central passage (not shown) which communicates through subsidiary passages with nozzles 18 mounted at the surface of the bit body. In known manner drilling fluid under pressure is delivered to the nozzles 18 through the internal passages and flows outwardly through the spaces 19, 20 between adjacent blades for cooling and cleaning the cutters. The spaces 19, 20 lead to junk slots 21 through which the drilling fluid flows upwardly through the annulus between the drill string and the surrounding formation. The junk slots 21 are separated by gauge pads 22 which bear against the side wall of the borehole and are formed with bearing or abrasion inserts 23.

The bit body and blades may be machined from metal, usually steel, which may be hardfaced. Alternatively the bit body, or a part thereof, maybe molded from matrix material using a powder metallurgy process. The methods of manufacturing drill bits of this general type are well known in the art and will not be described in detail.

FIGS. 3 and 5 are sections through prior art preform cutting elements mounted on a rotary drag-type drill bit.

Referring to FIG. 3, the bit body 110 is formed with a part cylindrical pocket 111 in which is brazed a preform cutting element 112, the braze alloy being indicated at 113.

The cutting element comprises a circular front facing table 114 of polycrystalline diamond bonded to a cylindrical substrate 115 of cemented tungsten carbide. The facing table 114 is co-extensive with the substrate 115 so that the whole of the peripheral edge of the facing table is exposed around the periphery of the cutting element. In this instance the interface 116 between the facing table and substrate is flat.

Since the braze material 113 cannot wet the polycrystalline diamond material of the substrate, as indicated diagrammatically at 117, the whole of the outer surface of the cutting element which engages the inner surface of the pocket 110 is not actually bonded to that inner surface, so that the effective surface area of the bonding is not as great as it could be. Furthermore, the component parallel to the front face of the facing table 114 of any impact load on the cutting edge 118 of the element is borne solely by the shear strength of the bond at the interface 116 between the facing table and the substrate. No effective support to resist this component of the impact load is provided by the comparatively soft braze material 113.

Similar comments apply to the other prior art arrangement shown in FIG. 4 where the facing table 114 actually protrudes from the mouth of the pocket 111.

Figure 6:
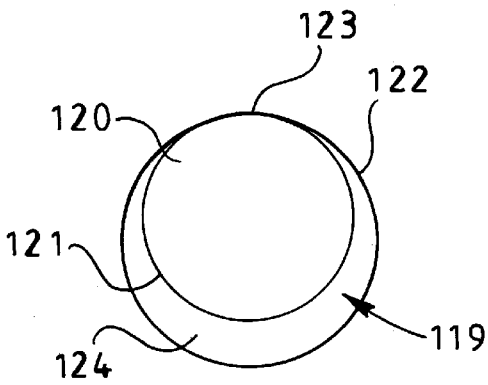
FIG. 6 is a front view of the cutting element shown in FIG. 5.

In the arrangement according to the invention shown in FIGS. 5 and 6 the substrate 119 is again cylindrical but in this case the circular facing table 120 extends across only a part of the front surface of the substrate. At one side of the cutting element the peripheral edge 121 of the facing table is tangential to the outer periphery 122 of the substrate and is therefore partly exposed, as indicated at 123, to form the cutting edge of the element. Around the rest of the facing table 120, however, the peripheral edge 121 of the facing table is engaged by the material of the substrate 119. As may be seen from FIG. 5, the front surface 124 of the region of substrate around the facing table is flush and co-planar with the front surface of the facing table 120 itself.

Consequently, most of the outer peripheral surface of the cutting element is provided by the substrate material, and indeed the whole of the outer surface of the element which engages the inner surface of the pocket 125 can be substrate material. Consequently, bonding by the braze alloy 126 occurs over the whole of the internal surface of the pocket.

Furthermore, the body of substrate material 127 which lies between the facing table and the wall of the pocket 125 around most of the periphery of the facing table serves to provide a physical support for the facing table to resist impact loads having a component in a direction parallel to the front surface of the facing table.

In the example of FIGS. 5 and 6, the rear surface of the facing table is formed with a thickened peripheral rim 128. This not only increases the thickness of the facing table at the cutting edge 123, thus providing greater resistance to wear and impact loads, but the shape of the interface thus provided between the facing table 120 and substrate 119 serves to improve the bond between the facing table and substrate.

However, it should be appreciated that the interface between the facing table and substrate shown in FIGS. 5 and 6 is by way of example only and this interface may be of any desired planar or non-planar configuration.

Figure 7:
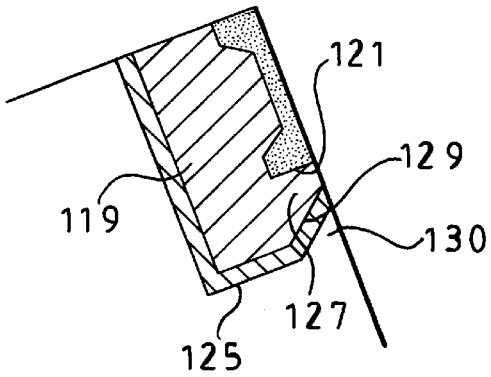
FIGS. 7–10 are similar views to FIG. 5 of alternative embodiments of the invention.
Figure 8:
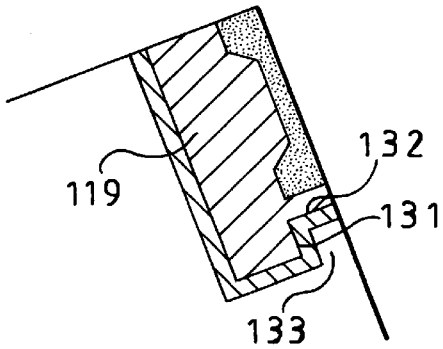

Another advantage of the present invention is that the part of the substrate which is not covered by the diamond facing table can be shaped so as partly to interlock with the material of the bit body to provide some mechanical retention of the cutting element in the socket, in addition to the braze. Two such arrangements are shown in FIGS. 7 and 8. These are modifications of the arrangement shown in FIGS. 5 and 6 and similar parts therefore bear the same reference numerals.

In the arrangement of FIG. 7 the portion 127 of the substrate 119 which is bonded to the peripheral edge 121 of the facing table is formed with an angled chamfer 129 which extends from the periphery of the substrate to the front surface and extends around part of the periphery of the substrate. The pocket 125 in the bit body has a corresponding tapered flange 130 which overlies the chamfer 129 and is brazed to it. The flange 130 serves to enhance the retention of the cutting element in the pocket and the arrangement also increases the area of braze between the substrate and the interior wall of the pocket.

In the modified arrangement shown in FIG. 8 the rebate around part of the periphery of the substrate 119 has a bottom wall 131 and a side wall 132 so that the rebate is generally rectangular in section. A correspondingly shaped flange 133 formed on the bit body is brazed within the rebate.

Figure 9:
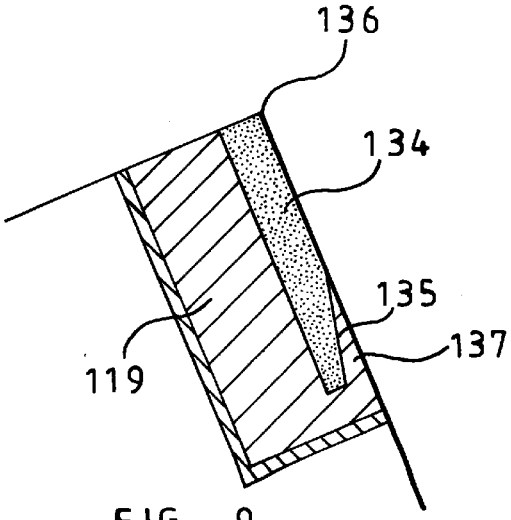
Figure 10:
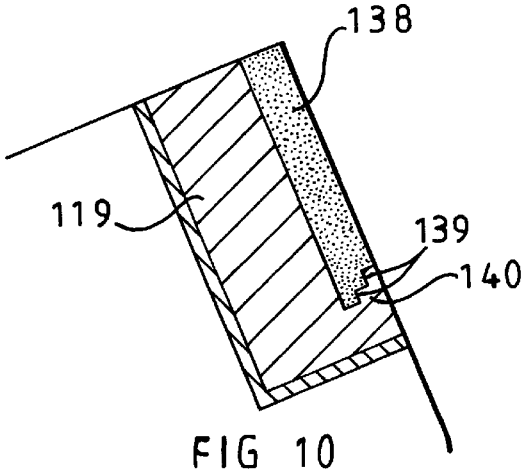

Since the facing table does not extend across the whole area of the substrate, it becomes possible to so shape the facing table that a part of the substrate can overlie part of the facing table thereby mechanically assisting the retention of the facing table on the substrate and thereby further reducing the risk of delamination. Such arrangements are shown in FIGS. 9 and 10. In the arrangement of FIG. 9 the front face of the facing table 134 is chamfered, as indicated at 135, in a region opposite the cutting edge 136 of the facing table. The chamfer may be a straight chamfer extending across a chord of the circular facing table, or the chamfer may be curved, extending around part of the periphery of the facing table.

Due to the presence of the chamfer a part 137 of the substrate 119 overlies the portion of the facing table 134 where the chamfer is formed, and thus helps retain the facing table on the substrate.

In the alternative arrangement shown in FIG. 10, the facing table 138 is formed with stepped rebate 139 in the region opposite the cutting edge and a portion 140 of the substrate 119 fills the rebate and thus assists in retaining the facing table on the substrate. As before, the rebate 139 may be straight, extending across a chord of the facing table, or may extend around part of the periphery of the facing table.

FIGS. 11–13 illustrate various methods by which preform elements according to the present invention may be manufactured.

Referring to FIG. 11, a circular intermediate member 141 is formed comprising a substrate 142 of cemented tungsten carbide in the centre of which is formed a concentric circular facing table 143 of smaller diameter. This intermediate member is manufactured by the normal processes by which preform elements are manufactured. Thus, the substrate 142 may be preformed with a central circular recess into which particulate diamond material is packed, the assembly then being submitted to extreme temperature and pressure in a press to bond the diamond particles together and to the substrate.

In order to produce from this intermediate member a preform element in accordance with the invention, part of the substrate is removed along the dotted line 144 of FIG. 11 so as to expose a part of the periphery of the facing table 143, as indicated at 145. The facing table 143 then extends across only part of the preform element. The region 145 forms the cutting edge of the element and the facing table 143 is supported by the portion of substrate which is opposite the cutting edge portion 145.

In the modified arrangement shown in FIG. 12 the circular facing table 146 is eccentric in relation to the substrate 147 and in this case a constant thickness peripheral layer of the substrate is then removed, as indicated by the dotted line 148 so as to expose a portion 149 of the facing table 146 to form the cutting edge of the element.

In either of the arrangements of FIGS. 11 and 12 the removal of the substrate material to expose part of the periphery of the facing table may be effected by electrical discharge machining (EDM), by grinding, by a combination of these methods, or by any other suitable process.

In the arrangement of FIG. 13 a large intermediate element 150 is formed with three inlaid circular facing table regions 151. Circular elements, each incorporating one of the facing tables 151, are then cut from the intermediate member as indicated by the dotted lines 152. In each case the facing table 151 lies adjacent the periphery of the resulting element.

Instead of methods of the kind shown in FIGS. 11–13, utilizing an intermediate member, preform elements according to the invention may also simply be made by the normal methods used to manufacture prior art preform elements. That is to say a substrate of the required configuration is preformed with a recess corresponding to the shape of the required facing table. The recess is then packed with diamond particles and submitted to the conventional heating and pressing process to produce the element.

Once a preform element has been formed in the press it is normally necessary to grind the periphery of the element to provide a smooth surface and eliminate any irregularities which might lead to stress concentrations, with a consequent risk of cracks being initiated. Also, such grinding may be partly effected to size the element accurately. In prior art elements where the peripheral edge of the facing table is exposed around the whole periphery of the element, such grinding necessitates removal of polycrystalline diamond around the whole periphery of the element, and this may be a costly and time-consuming process due to the extreme hardness of the diamond. An additional advantage of preform elements according to the present invention is that diamond may form only a small part of the peripheral surface of the element, thus facilitating the grinding process.

In the examples of the invention described above, and shown in the drawings, the peripheral surface of each facing table and substrate is referred to as circular, or near-circular, since this is a common shape for preform cutting elements. However, it must be stressed that the invention is not limited to circular or part-circular arrangements but is applicable to elements having a facing table and/or substrate of virtually any peripheral shape, including both regular and irregular shapes. Indeed, in some circumstances making the facing table and/or the substrate of non-circular shape may enable better advantage to be taken of the benefits provided by the invention.

Whereas the present invention has been described in particular relation to the drawings attached hereto, it should be understood that other and further modifications, apart from those shown or suggested herein, may be made within the scope and spirit of the present invention.

What is claimed:

1. A preform cutting element, for a rotary drag-type drill bit, including a facing table of superhard material having a front face, a peripheral surface, and a rear surface bonded to the front surface of a substrate which is less hard than the superhard material, the facing table extending across only a part of the front surface of the substrate, and part of the substrate engaging the peripheral surface of the facing table.

2. A preform element according to claim 1, wherein the peripheral surface of the facing table is at least partly circular.

3. A preform element according to claim 1, wherein the peripheral surface of the substrate is at least partly circular.

4. A preform element according to claim 1, wherein part of the peripheral surface of the facing table is exposed at the periphery of the preform element, so as to define the cutting edge of the element.

5. A preform element according to claim 1, wherein the front face of the substrate is exposed.

6. A preform element according to claim 5, wherein said part of the substrate which engages the peripheral surface of the facing table has a front surface which is substantially co-planar with the front face of the facing table.

7. A preform element according to claim 6, wherein the front face of the facing table, and the co-planar front surface of the part of a substrate, are substantially flat.

8. A preform element according to claim 1, wherein the part of the substrate which engages the periphery of the facing table also overlies part of the front face of the facing table.

9. A preform element according to claim 8, wherein the front face of the facing table is formed with a rebate adjacent part of the periphery thereof, said rebate being at least partly filled with material of the substrate.

10. A preform element according to claim 9, wherein said rebate has a bottom wall and a side wall.

11. A preform element according to claim 1, wherein said rebate comprises a chamfer extending from the periphery of the facing table to a region of the front face thereof inward of the periphery.

12. A preform element according to claim 1, wherein the facing table and substrate have respective central axes, the axis of the facing table being displaced from the axis of the substrate so that one part of the periphery of the facing table lies at the periphery of the substrate and another part of the periphery of the facing table is spaced inwardly from the periphery of the substrate.

13. A preform element according to claim 12, wherein the facing table and the substrate are generally circular.

14. A preform element according to claim 1, wherein there is provided a non-planar interface between the rear surface of the facing table and the front surface of the substrate.

15. A preform element according to claim 14, wherein the facing table is formed with a thickened peripheral rim which projects into a correspondingly shaped groove in the substrate.

16. A preform element according to claim 1, wherein part of the front face of the substrate is exposed and is formed with a rebate adjacent part of the periphery of the substrate.

17. A preform element according to claim 16, wherein said rebate in the substrate has a bottom wall and a side wall.

18. A preform element according to claim 16, wherein said rebate in the substrate comprises a chamfer extending from the periphery of the substrate to a region of the substrate inward of the periphery.

19. A preform element according to claim 1, wherein there is provided a transition layer between the superhard material and the less hard material, the transition layer comprising material having at least one property which is intermediate the corresponding properties of the superhard and less hard materials.

20. A rotary drag-type drill bit having a bit body formed with at least one pocket in which is received a preform cutting element including a facing table of superhard material having a front face, a peripheral surface, and a rear surface bonded to the front surface of a substrate which is less hard than the superhard material, the facing table extending across only a part of the front surface of the substrate, and part of the substrate engaging the peripheral surface of the facing table, the pocket having an inner peripheral surface to which a part of the outer periphery of the preform element is brazed, including the outer periphery of said part of the substrate which engages the peripheral surface of the facing table.

21. A drill bit according to claim 20, wherein a part of the material of the bit body overlies part of the substrate so as to assist in retaining the element in the pocket.

22. A drill bit according to claim 21, wherein a part of the front face of the substrate of the cutting element is formed with a rebate adjacent part of the periphery of the substrate, and wherein a part of the material of the bit body engages within said rebate.

23. A drill bit according to claim 22, wherein said rebate has a bottom wall and a side wall.

24. A drill bit according to claim 22, wherein said rebate comprises a chamfer extending from the periphery of the substrate to a region of the front surface thereof inward of the periphery.

25. A method of manufacturing a preform cutting element, comprising forming an intermediate member having a facing table of superhard material extending across only a part of a substrate of less hard material, and then removing material from the intermediate member to leave a smaller preform element wherein only a part of the periphery of the facing table is exposed at the periphery of the preform element.

26. A method according to claim 25, wherein the intermediate member comprises a single facing table spaced inwardly from the periphery of the substrate, at least part of the periphery of the substrate of the intermediate member subsequently being removed to expose part of the periphery of the facing table.

27. A method according to claim 25, wherein the intermediate member comprises a plurality of facing tables spaced apart on the front surface of the substrate of the intermediate member, each facing table, together with an adjacent larger area of substrate, being subsequently separated from the intermediate member to provide a plurality of preform elements.

* * * * *